US009758939B2

(12) United States Patent
Adams

(10) Patent No.: US 9,758,939 B2
(45) **Date of Patent: *Sep. 12, 2017**

(54) MULTI-PART REUSABLE LEVEE BAG

(71) Applicant: Beau G. Adams, Louisville, KY (US)

(72) Inventor: Beau G. Adams, Louisville, KY (US)

( * ) Notice: Subject to any disclaimer, the term of this patent is extended or adjusted under 35 U.S.C. 154(b) by 89 days.

This patent is subject to a terminal disclaimer.

(21) Appl. No.: 14/731,899

(22) Filed: Jun. 5, 2015

(65) Prior Publication Data

US 2015/0267368 A1 Sep. 24, 2015

Related U.S. Application Data

(63) Continuation-in-part of application No. 13/796,490, filed on Mar. 12, 2013, now Pat. No. 9,587,366, and a continuation-in-part of application No. 13/760,594, filed on Feb. 6, 2013, now Pat. No. 9,267,251, application No. 14/731,899, which is a continuation-in-part of application No. 13/760,594.

(60) Provisional application No. 62/008,835, filed on Jun. 6, 2014, provisional application No. 61/762,665, filed on Feb. 8, 2013, provisional application No. 61/713,079, filed on Oct. 12, 2012.

(51) Int. Cl.
*E02B 3/10* (2006.01)
*E02D 29/02* (2006.01)

(52) U.S. Cl.
CPC ..... *E02B 3/108* (2013.01); *E02D 29/02* (2013.01)

(58) Field of Classification Search
USPC ..... 405/107, 111
See application file for complete search history.

(56) References Cited

U.S. PATENT DOCUMENTS 1,406,068 A 2/1922 Padgett
1,418,403 A 6/1922 Smith
(Continued)

FOREIGN PATENT DOCUMENTS

EP 2299003 3/2011
JP 11029151 2/1999
(Continued)

OTHER PUBLICATIONS

Korean Intellectual Property Office, International Search Report for corresponding PCT Application No. PCT/US2013/064875, pp. 1-14, Jan. 17, 2014, Daejeon Metropolitan Dity, Republic of Korea.
(Continued)

*Primary Examiner* — Thomas B Will
*Assistant Examiner* — Katherine Chu
(74) *Attorney, Agent, or Firm* — Middleton Reutlinger

(57) ABSTRACT

A multi-part reusable retaining wall and levee bag. The reusable levee bag includes a top bag section and a bottom bag portion removably affixed to the top bag portion. The combined top bag section and bottom bag portion define an interior space within which fillable material may be received to form a levee bag for use in flooding and other installations. The bottom bag section includes a receiving cell for receiving an end of another levee bag to connect multiple levee bags end to end to form a retaining wall with minimal gaps between levee bags. The bottom bag section is made of a biodegradable material while the top bag section is made of an alternative material. The reusable levee bag, once filled, may be disassembled and the top bag section reused while the bottom bag section may remain in place to biodegrade.

20 Claims, 9 Drawing Sheets

(56) References Cited

U.S. PATENT DOCUMENTS

| | | | |
|---|---|---|---|
| 1,475,603 | A | 11/1923 | Sheridan |
| 1,983,418 | A | 12/1934 | Thurmer |
| 2,570,851 | A | 10/1951 | Peyser |
| 2,586,557 | A | 2/1952 | Newbold |
| 2,672,903 | A | 3/1954 | Machinist |
| 2,767,936 | A | 10/1956 | Ringen et al. |
| 2,813,704 | A | 11/1957 | MacKissic |
| 3,552,346 | A | 1/1971 | Garden |
| 3,886,751 | A | 6/1975 | Porraz Jimenez Labora |
| 4,126,213 | A | 11/1978 | McDonald |
| 4,184,522 | A | 1/1980 | Waite |
| 4,362,433 | A | 12/1982 | Wagner et al. |
| 4,650,368 | A | 3/1987 | Bayer |
| 4,674,127 | A | 6/1987 | Yamada et al. |
| 4,700,818 | A | 10/1987 | Orwin |
| 4,784,520 | A | 11/1988 | Stevens |
| 5,015,123 | A | 5/1991 | Houck et al. |
| 5,051,028 | A | 9/1991 | Houck et al. |
| 5,154,543 | A | 10/1992 | Houck et al. |
| 5,176,468 | A | 1/1993 | Poole |
| 5,244,019 | A | 9/1993 | Derby |
| 5,378,357 | A | 1/1995 | Houck et al. |
| 5,425,403 | A | 6/1995 | Herrmann |
| 5,443,102 | A | 8/1995 | Svendsen |
| 5,509,229 | A | 4/1996 | Thomasson et al. |
| 5,535,499 | A | 7/1996 | Houck et al. |
| 5,538,155 | A | 7/1996 | Hoekstra |
| 5,584,599 | A | 12/1996 | Knittel |
| 5,605,416 | A | 2/1997 | Roach |
| 5,771,665 | A | 6/1998 | Nelson et al. |
| 5,894,871 | A | 4/1999 | Greer |
| 5,901,762 | A | 5/1999 | Rollins |
| 5,971,661 | A | 10/1999 | Johnson et al. |
| 5,988,237 | A | 11/1999 | Bedsole |
| 6,126,362 | A | 10/2000 | Carter |
| 6,334,736 | B1 | 1/2002 | Johnson |
| 6,390,154 | B1 | 5/2002 | Hall |
| 6,637,474 | B2 | 10/2003 | Hall |
| 6,672,799 | B2 | 1/2004 | Earl |
| 6,708,835 | B1 | 3/2004 | Mathis |
| 6,994,132 | B2 | 2/2006 | Antrobus |
| 7,056,058 | B2 | 6/2006 | Urriola et al. |
| 7,237,753 | B2 | 7/2007 | Metcalfe |
| 7,281,879 | B2 | 10/2007 | Cho |
| 7,431,534 | B2 | 10/2008 | Harbeck |
| 7,651,298 | B2 | 1/2010 | Boudreaux, Jr. |
| 7,708,495 | B1 | 5/2010 | Antee |
| 7,794,148 | B2 | 9/2010 | Derby et al. |
| 7,900,757 | B2 | 3/2011 | Sisitsky |
| 7,918,996 | B1 | 4/2011 | de Bruijn |
| 7,922,421 | B2 | 4/2011 | McGillick, Sr. et al. |
| 7,958,995 | B2 | 6/2011 | Dedmon et al. |
| D655,426 | S | 3/2012 | Otten |
| 8,235,631 | B2 | 8/2012 | Adams et al. |
| 8,382,398 | B2 | 2/2013 | Stauffacher |
| 8,602,692 | B2 | 12/2013 | Adams et al. |
| 8,672,585 | B2 | 3/2014 | Schnaars, Sr. et al. |
| 8,678,652 | B1 | 3/2014 | Nattrass |
| 8,721,221 | B2 | 5/2014 | Cavenagh |
| 8,864,411 | B2 | 10/2014 | Taylor |
| 9,004,815 | B2 | 4/2015 | Taylor |
| 2001/0027826 | A1 | 10/2001 | Carpenter |
| 2004/0156680 | A1 | 8/2004 | Gibbs |
| 2006/0222270 | A1 | 10/2006 | Modena |
| 2007/0140598 | A1 | 6/2007 | McGillick et al. |
| 2010/0278591 | A1 | 11/2010 | Tasker |
| 2012/0195687 | A1 | 8/2012 | Beard et al. |
| 2012/0207406 | A1 | 8/2012 | Cavenagh et al. |
| 2012/0230766 | A1 | 9/2012 | Schnaars, Sr. et al. |
| 2014/0021144 | A1 | 1/2014 | Lane |
| 2014/0050537 | A1 | 2/2014 | Adams |
| 2014/0102581 | A1 | 4/2014 | Adams |
| 2014/0105684 | A1 | 4/2014 | Allard |
| 2014/0226918 | A1 | 8/2014 | Adams |
| 2015/0023733 | A1 | 1/2015 | Schnaars, Sr. et al. |

FOREIGN PATENT DOCUMENTS

| | | |
|---|---|---|
| JP | 11190015 | 7/1999 |
| JP | 2000129646 | 5/2000 |
| JP | 2003074061 | 3/2003 |

OTHER PUBLICATIONS

Korean Intellectual Property Office, International Search Report and Written Opinion for corresponding PCT Application No. PCT/US2013/064873, pp. 1-17, Jul. 9, 2014, Daejeon Metropolitan Dity, Republic of Korea.

MULTI-PART REUSABLE LEVEE BAG

CROSS-REFERENCE TO RELATED DOCUMENTS

This Patent Application claims priority to the U.S. Provisional Patent Application Ser. No. 62/008,835, filed on Jun. 6, 2014, the entire contents of which are hereby incorporated by reference in their entirety.

This Patent Application also claims priority under 35 U.S.C. §120 as a continuation in part of utility application Ser. No. 13/796,490 filed on Mar. 12, 2013 and entitled "Multi-Part Reusable Levee Bag with Biodegradable Portions" which claims priority to Provisional Application 61/762,665 filed Feb. 8, 2013. Patent application Ser. No. 13/796,490 filed on Mar. 12, 2013 is also a continuation in part of utility application Ser. No. 13/760,594 filed on Feb. 6, 2013, which claims priority to Provisional Application 61/713,079 filed Oct. 12, 2012.

This Patent Application also claims priority under 35 U.S.C. §120 as a continuation in part of utility application Ser. No. 13/760,594 filed on Feb. 6, 2013 which claims priority to Provisional Application 61/713,079 filed Oct. 12, 2012 and entitled "Multi-Part Reusable Levee Bag", all of which are hereby incorporated by reference in their entirety.

TECHNICAL FIELD

Described is a multi-part reusable retaining wall and levee system bag. More particularly, a two piece reusable retaining wall and levee bag is disclosed having a top and bottom bag portion which are removably affixed to each other and which have structures for securing the bags in end to end relationship.

BACKGROUND

Retaining wall bags, flood control bags and levee systems have been achieved by utilizing concrete retaining structures, one-time use sand bags and the like. However such bags and structures may only be used for a single installation and are labor intensive to fill when implemented as a refillable retaining structure. Further these bags must be stacked vertically to prevent flooding, a labor intensive operation, and are destroyed when disassembled. It is therefore desirable to utilize bags which may be automatically filled utilizing a backhoe or other machinery and which mechanizes the bag filling operation as well as using a bag which may be reused in multiple installations.

Such prior art bag filling systems have also utilized large filling sleds with a unitary bag construction which allows a larger volume bag to be filled by a mechanized process. However these large volume bags, once filled, cannot be reused and also must be destroyed once the need for a temporary levee has passed.

Thus there is a need in the art to provide a method and bag system, as well as, an apparatus which provides a portable and reusable levee bag. The levee bag may be filled on location and subsequent to the need for the temporary levee, may be removed, reconditioned and then reused. The methods, system and apparatus for a multi-part reusable levee bag as set forth herein may, for example, allow for reuse.

SUMMARY

The present disclosure is directed towards methods and apparatus for a multi-part reusable levee bag. The multi-part reusable levee bag is, in various embodiments, a multi-part bag which may be filled with a flowable material such as sand and which may then be emptied after use. The bag may then be reconditioned and reused. For example, a two piece bag having an upper portion and a lower portion may be connected and filled with sand utilizing a levee bag filling frame or sled. In some embodiments, the multi-part reusable bag may include a top bag portion which is removably attached to a bottom bag portion. The top bag portion may be configured to be attached securely to the bottom bag portion such that an interior enclosed space is defined which securely retains a flowable material. The filled multi-part reusable levee bag may be utilized in flood control projects, earthen support and like applications. In even further embodiments, the bag may have structures allowing a plurality of bags to be placed end to end and securely affixed to each other in such position to strengthen the overall combined bag structure. For example, the bag may have a female end that includes a receiving cell, and an oppositely disposed male end insertable into the female end of another bag.

Generally, in one aspect, a multi-part reusable levee bag is provided for filling, emptying and reuse. The reusable levee bag includes a top bag portion with an open top and an open bottom wherein the top bag portion and open top may be dimensionally smaller than the open bottom. As well, in some variations, the top bag portion may have guides extending from a top edge of the top bag portion and the top bag portion defines an interior space. Combined with the top bag portion is a bottom bag portion which is removably retained thereto, the bottom bag portion having a first side flap extending from a bottom panel of the bottom bag portion. The bottom bag portion further may have a second side flap extending from the bottom panel. The interior space defined by the top bag portion may include at least one baffle or side panel interrupting the interior space. In various embodiments, the plurality of side panels or baffles may be intermittently positioned between first and second end panels of the top bag portion. The combined top bag portion and bottom bag portion therefore define an enclosed multi-part levee bag capable of receiving flowable material therein. A receiving cell may be positioned adjacent to at least one end panel. The receiving cell may accept a second levee bag (or a portion thereof, e.g., a male end opposite the receiving cell), such that multiple levee bags may be connected end to end. In various embodiments, the receiving cell may be attached or connected to the bottom bag portion.

In some embodiments, the receiving cell may include a plurality of flaps or panels, such as, for example, a bottom flap between two opposing side flaps, the three of which may substantially define the periphery of a substantially U-shaped receiving cell.

In some embodiments, the guides may be along top edges of the first and second side panel of the top bag portion.

In still other embodiments, the guides may be positioned in a transverse direction of the longitudinal axis of the reusable bag and extend along the end or baffle panels of the top bag portion.

In various embodiments, the guides may be hangar bars and in still other embodiments these hangar bars may be received within sleeves, loops or other retention devices to retain the bar to the top bag portion and allow the reusable bag to slide along a filling frame.

In various embodiments, the top and bottom bag portions may be made of different material wherein the top bag portion is comprised of a stronger thermoplastic based material, such as polypropylene, while the bottom bag portion may be made of a biodegradable material, such as an organic based material.

In various embodiments, the bottom bag portion may be substantially comprised of a biodegradable material while also having a small amount of non-biodegradable components to increase strength. In various constructions, these non-biodegradable components of the bottom bag portion may be along the seams or other structurally significant areas.

In still other variations, the bottom bag portion may be comprised of biodegradable material.

In some embodiments, the bottom bag portion may be comprised of a cellulose based material.

In even further embodiments, the bottom bag portion may be comprised of jute or similar plant fiber based material.

In some embodiments, the reusable levee bag top bag portion is removably retained to the bottom bag portion by a plurality of connectors.

In some embodiments, the top bag portion may also have a plurality of straps which are received within a plurality of strap receivers on the bottom bag portion.

In other embodiments, the top bag portion may have first and second opposing end panels and further may include a plurality of interposed baffles or side panels which extend from a first side of the top bag portion to a second side of the top bag portion.

In other examples, the reusable levee bag includes a plurality of baffles which extend substantially from the open top to substantially the open bottom of the top bag portion.

In various embodiments, the reusable levee bag also includes a plurality of travel guides which in still further embodiments include an ovalized head connected to the top bag portion by a narrow neck.

In some embodiments, the bottom bag portion is removably affixed to the top bag portion by a plurality of hook and loop fasteners.

In still other embodiments, the reusable levee bag includes various affixation means in order to removably attach the top bag portion to the bottom bag portion.

In still further embodiments, the reusable levee bag includes a bottom bag portion and defined with a bottom panel and first and second side flaps. Further, the bottom bag portion may in other embodiments also optionally include opposing first and second end flaps that, when the first and second side flaps and the first and second end flaps extend upward towards the top bag, may substantially surround the open bottom of the top bag portion in order to enclose the interior space defined therein.

In other embodiments, the combined top and bottom bag portion may be a multi-sided shape.

Still further embodiments allow the reusable levee bag to include a plurality of baffle or side panels in the top bag portion within the interior space wherein the baffle panels are similarly multi-sided in shape.

Generally, in another aspect, a reusable levee bag is provided, which includes a top bag portion and a bottom bag portion, the top bag portion being removably attached to the bottom bag portion. The bottom bag portion may include a receiving cell disposed at an end of the bottom bag portion, wherein the receiving cell may receive a second levee bag (or a portion thereof, e.g., a male end disposed opposite the receiving cell or female end). In this way, for example, multiple levee bags may be connected and/or attached end to end. The top bag portion may have an open top and an open bottom wherein the open top is dimensionally smaller than the open bottom. The top bag portion may be removably retained to the bottom bag portion by a plurality of removably attachable mechanisms wherein when the top bag portion and bottom bag portion are combined, the combined portions define an enclosed interior space forming a levee bag.

In some embodiments, the bottom bag portion may have a first and second side flap extending upwards towards at least a portion of the top bag portion.

In still further embodiments, the top bag portion and the bottom bag portion may be removably attached by a plurality of straps and rings.

In still other embodiments, the bottom bag portion may have at least one end flap releasably attached to the top bag portion.

In some embodiments, the reusable levee bag may further include a plurality of multi-sided shaped baffle or side panels in the enclosed interior of the top bag portion.

In still further embodiments, the reusable levee bag may further include a plurality of guides affixed to the top bag portion and configured to allow the reusable levee bag to slide along a first and second rail of a bag filling frame or sled.

Generally, in another aspect, a two piece reusable levee bag is disclosed which include a top bag portion and a bottom bag portion wherein the top bag portion is removably affixed to the bottom bag portion. The combined top and bottom bag portions form an enclosed interior space having a plurality of baffles or side panels forming individual compartments therein. The top bag portion may have a narrow top opening wherein the bottom opening of the top bag portion is wider than the top opening. The combined top bag portion and bottom bag portion therefore receive a flowable fill material which is received within the interior space. The top bag portion may be adapted to be removed from the bottom bag portion when the flowable fill material is within the interior space causing the flowable fill material to spill outside of the combined top and bottom bag sections.

In some embodiments, the top bag portion may include a multi-sided cross section. In other embodiments, this cross section may be quadrilateral. In still further examples, this cross section may be trapezoidal or other multi-sided configuration.

In other embodiments, the top bag portion may include a plurality of upwardly extending travel or channel guides.

In some embodiments the channel guides may each have an enlarged ovalized head and a neck.

In some embodiments, the bottom bag portion may have a bottom panel and a first and second side flap which are affixable to the top bag section by a plurality of removably attachable fasteners.

The bottom bag portion and the top bag portion may also include in some embodiments a plurality of removably affixable fasteners which allow the top bag portion to be securely fastened to the bottom bag portion.

In still further embodiments, the top bag portion includes a plurality of straps received within a plurality of correspondingly positioned strap receivers on the bottom bag portion.

Other embodiments include a top bag portion and a bottom bag portion which have hook and loop style fasteners to removably retain the top bag portion to the bottom bag portion.

Generally in another aspect, a two piece reusable levee bag is disclosed and described which includes a top bag having a top opening and a bottom opening and also having front, a back and two end panels. The top opening of the top bag may be smaller than the bottom opening. Further, the two piece reusable levee bag may include a bottom section which is removably affixable to the top bag, the bottom section having a bottom panel whereby the top bag is affixed to the bottom section and whereby the combined top bag and bottom section form an enclosed interior space. The enclosed interior space may be fillable through the top opening of the top bag. The enclosed interior space may further have a plurality of baffles positioned therein and the top bag may be attached to the bottom bag by a plurality of connectors. The bottom section may include or one or more flaps and/or panels extending outwardly from an end of the bottom section. The flaps and/or panels may form a receiving cell. At an end of the bottom section opposite the receiving cell there may be a male end, which may be insertable into the receiving cell of another levee bag. In various embodiments, a first levee bag may be connected to a second levee bag by insertion of the male end of one levee bag into the receiving cell of another levee bag. In this way, for example, multiple levee bags may be connected end to end. The receiving cell may facilitate and/or enhance the structural connection of the levee bags and/or enhance or facilitate the ability of a flood wall, formed of multiple levee bags connected together via receiving cell(s), to prevent or reduce ingress of flood waters, for example.

In some embodiments, the plurality of connectors may include a plurality of straps and combined strap receivers.

In still further embodiments, the plurality of connectors may include hook and loop type fasteners.

In still further embodiments, the enclosed interior space may be capable of being filled with a flowable material through the top opening.

In further embodiments, the top bag may be removable from the bottom section after the interior space is filled with the flowable material.

In another aspect, a method is detailed for forming a multi-part levee bag which includes forming a multi-sided shaped top bag having first and second end panels and first and second side panels. The method includes interposing a plurality of baffle panels in between the end panels to create separate compartments therein. The top bag and bottom section may be removably affixed together by folding at least one side flap of the bottom section against a side panel of the top bag, the combined top bag and bottom section forming an interior space adapted for receiving filling material therein.

Generally in another aspect, a method of filling a reusable bag is provided which includes removably attaching a top bag to a bottom bag portion, the top bag having an open top and an open bottom, the open bottom substantially covered by the removable bottom bag portion. At least one side flap of the bottom bag portion is folded to a first side of the top bag to affix it thereto. The combined bag may be slidably affixed to a bag filling frame thereby allowing the combined bag to be expanded to define an interior space which is substantially quadrilateral or multi-sided in shape. The expanded multi-part bag may be slid into a bag filling frame to allow filling material to be deposited into the substantially interior space. The filled multi-part bag may then be removed from the frame for use.

It should be appreciated that all combinations of the foregoing concepts and additional concepts discussed in greater detail below provided such concepts are not mutually inconsistent are contemplated as being part of the inventive subject matter disclosed herein. In particular, all combinations of claimed subject matter appearing at the end of this disclosure are contemplated as being part of the inventive subject matter disclosed herein. It should be also appreciated that terminology explicitly employed herein but may also appear in any disclosure incorporated by reference should be accorded a meaning most consistent with the particular concepts disclosed herein.

BRIEF DESCRIPTION OF THE DRAWINGS

In the drawings, like reference characters, generally refer to the same parts throughout the different views. Also, the drawings are not necessarily to scale, and emphasis instead generally placed upon illustrating the principals of the invention.

DETAILED DESCRIPTION

Levee and retaining wall type bags may be filled and installed in various locales and for multiple purposes. These filling operations and bag designs are minimal in nature or do not allow for reuse of the levee bags. Previous levee and retaining wall bag systems have typically been filled and left in place and then destroyed upon passing of the need for the levee bags. Thus, Applicants recognize and appreciated the need for a multi-part reusable levee bag which may be filled in place and, after filling and use, may be disassembled, reconditioned and reused. For example, a reusable multi-part levee (or retaining wall) bag may be utilized in a flood location and, after the need for the levee bag has passed, the levee bag may be disassembled and reused. The multi-part reusable levee bag set forth herein, for example, includes various structures for disassembly of the filled levee bag since typical levee bag systems, once filled, must be destroyed in order to remove the levee bag from the filled position.

More generally, Applicants have recognized the need for a multi-part reusable levee bag system which may be filled in position and which may be disassembled and reused at a later time.

In view of the foregoing, various apparatus and methods are disclosed herein which relate to the use, filling, and construction of a multi-part reusable levee bag.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatus and methods may be omitted so as not to obscure the description of the representative embodiments. Such methods and apparatus are clearly within the scope of the claimed invention. For example, various embodiments of the apparatus disclosed herein are particularly suited for a multi-part reusable levee bag with a particular orientation for construction as well as geometric shape. Accordingly, for illustrative purposes, the description included herein is often discussed in conjunction with particular implementations described in the figures. However, other configurations of the multi-part reusable levee bag are contemplated without deviating from the scope or spirit of the claimed invention.

Figure 1:
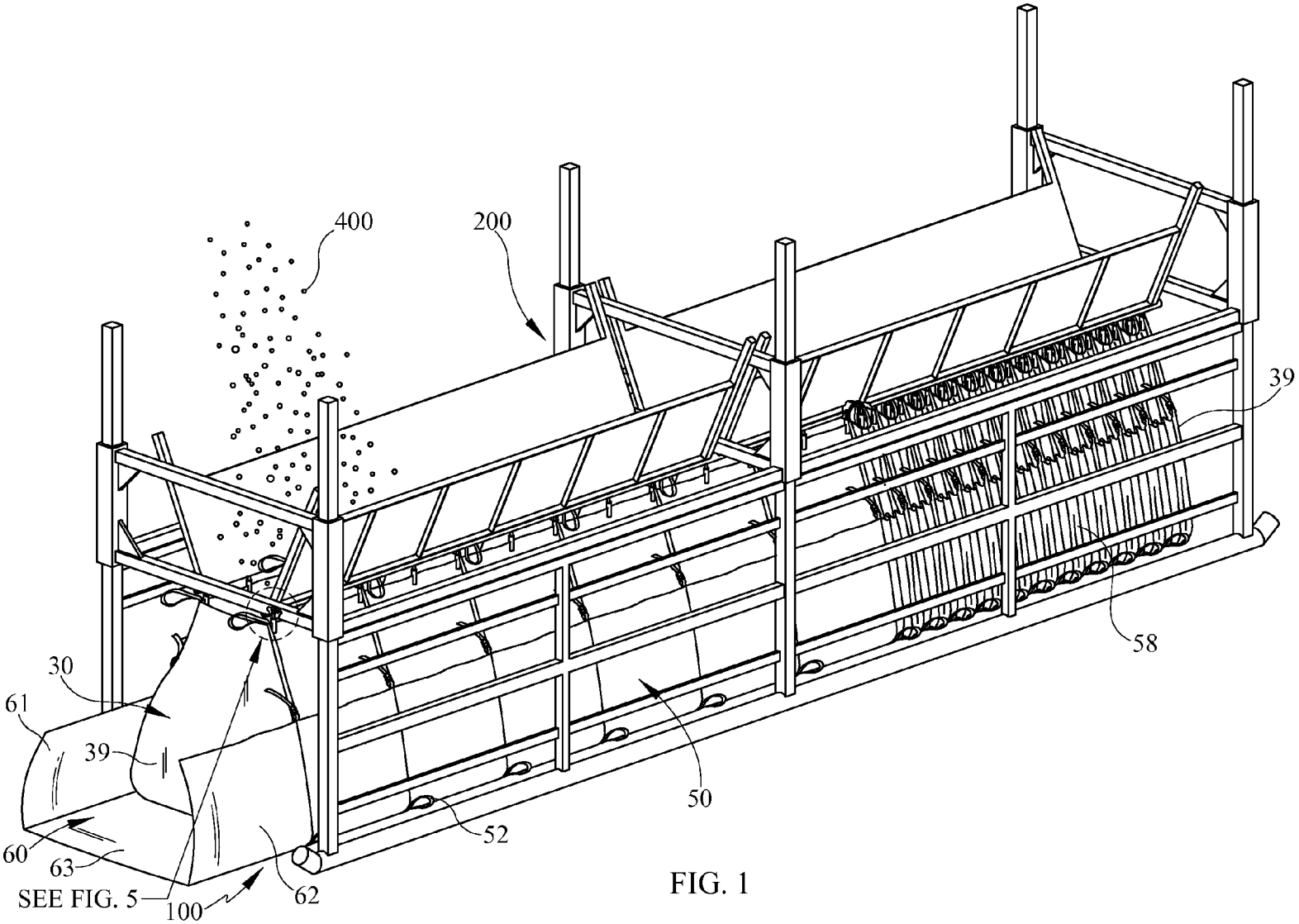
FIG. 1 illustrates the multi-part reusable levee bag retained within a bag filling frame or sled.

FIG. 1 details a multi-part reusable levee or retaining wall bag 100 which is positioned within a bag filling frame or sled 200. As disclosed and set forth within the fill operation depicted within FIG. 1, the multi-part reusable levee bag 100 is positioned in a fill station where the expanded section 50 is expanded for receiving a fill material such as sand and the like. The reusable levee bags 100 further include, as depicted within FIG. 1 and the embodiment thereof, a collapsed bag section 58 which is compressed in accordion fashion and which may be expanded as the filling operation proceeds.

In some embodiments the bag 100 may be installed within the bag filling frame or sled 200 and a backhoe or other machine may scoop material into the filling frame and fill the bags as they are expanded into the expanded section 50. Thus, high speed filling of the bags may be implemented.

Figure 2:
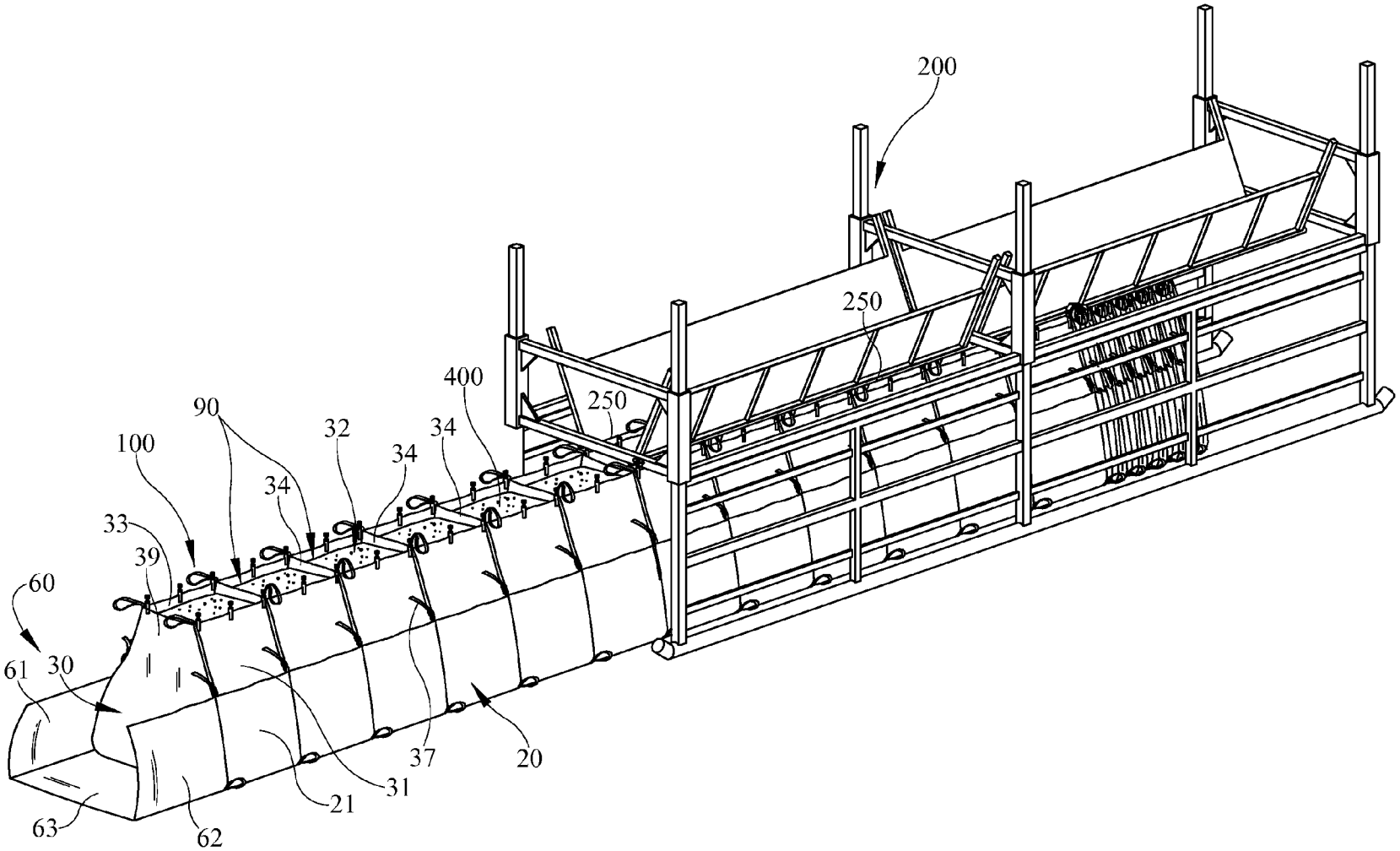
FIG. 2 illustrates a multi-part reusable levee bag partially filled with fillable material.

FIG. 2 depicts a partially filled bag 100 in which the frame 200 has been retracted from the filled portions of the reusable levee bag. Reusable levee bag 100 may include a top bag portion 30 and a bottom bag portion 20 which are detachably assembled together to form one or more interior spaces 90 within which the fill material is firmly positioned. As shown in FIGS. 1 and 2, once filled, the reusable multi-part levee bag 100 may be disassembled by disconnecting the various connector mechanisms attaching the top bag portion 30 to the bottom bag portion 20 thereby allowing the fillable material to flow exterior to the assembled bag and the bag portions subsequently removed.

A receiving cell 60, which may include a first side flap 61, a second side flap 62, and/or a third flap or bottom panel 63, may be positioned adjacent an end of multi-part reusable levee bag 100. Receiving cell 60 may be included, for example, to allow and/or facilitate attaching and/or connecting multiple levee bags 100 together end to end. At an end opposite the receiving cell 60, levee bag 100 and/or bottom bag portion 20 may have a second end or portion suitable for insertion into receiving cell 60 (e.g., receiving cell 60 may be a female end, and the second end opposite thereto may be a male end, such that the two ends may mate). Receiving cell 60, side flaps 61, 62, and/or bottom panel 63 may be included to, for example, reduce or eliminate gaps between adjacent levee bags 100 through which water may flow and/or to enhance the structural rigidity and/or connection of adjacent levee bags 100. Receiving cell 60 and/or any component thereof may be attached or connected to another levee bag 100 to, for example, further improve or enhance the sealing or water ingress prevention between adjacent levee bags 100.

In some embodiments, receiving cell 60 may be formed by folding side flaps 61 and 62 upwardly when bottom bag portion 20 is wrapped or folded around top bag portion 30. First side flap 61, second side flap 62, and/or bottom panel 63 may be portions of bottom bag portion 20 that extend beyond an end of top bag portion 30 to form an area suitable for receiving cell 60. In alternative embodiments, any or all of first side flap 61, second side flap 62, and bottom panel 63 may be attached or connected to one another and/or to bottom bag portion 20 by, for example, sewing, gluing, stitching, welding, stapling, nailing, bolting, attaching via hook-and-loop style and/or other fasteners, bonding, or any other attachment mechanism, or any combination thereof. It is understood that any or all of first side flap 61, second side flap 62, and bottom panel 63 may be integral with one another and/or with bottom bag portion 20 or any portion thereof. It is further understood that the length of any or all of first side flap 61, second side flap 62, and bottom panel 63 may vary as desired, although a length of about 2" to about 12" has been found to be sufficient in some cases. Furthermore, the lengths may vary, such that any or all of first side flap 61, second side flap 62, and bottom panel 63 may be same length or different length(s).

Figure 3:
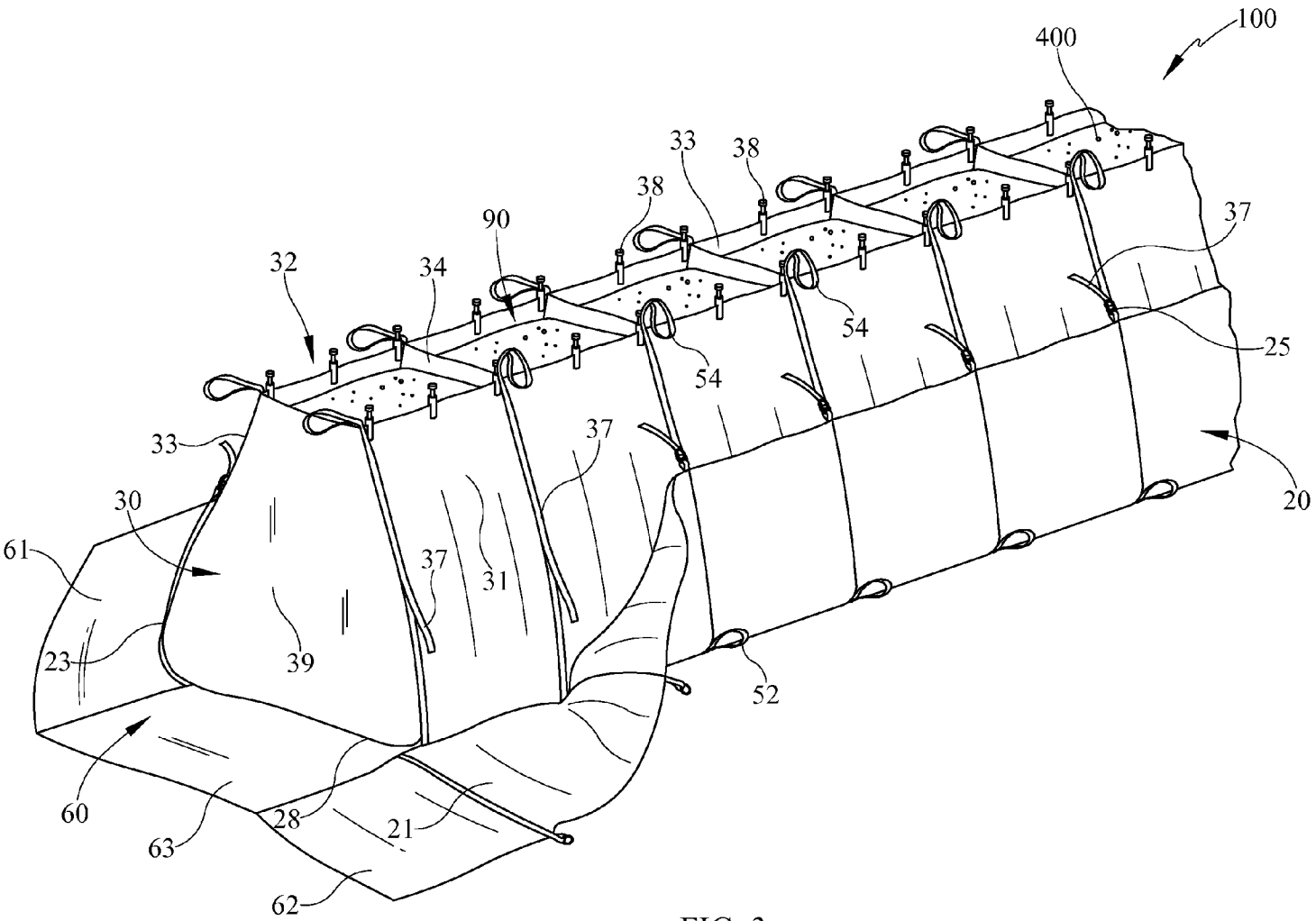
FIG. 3 illustrates a partially disassembled view of the multi-part reusable levee bag exposing the interior of the bottom bag section.
Figure 4:
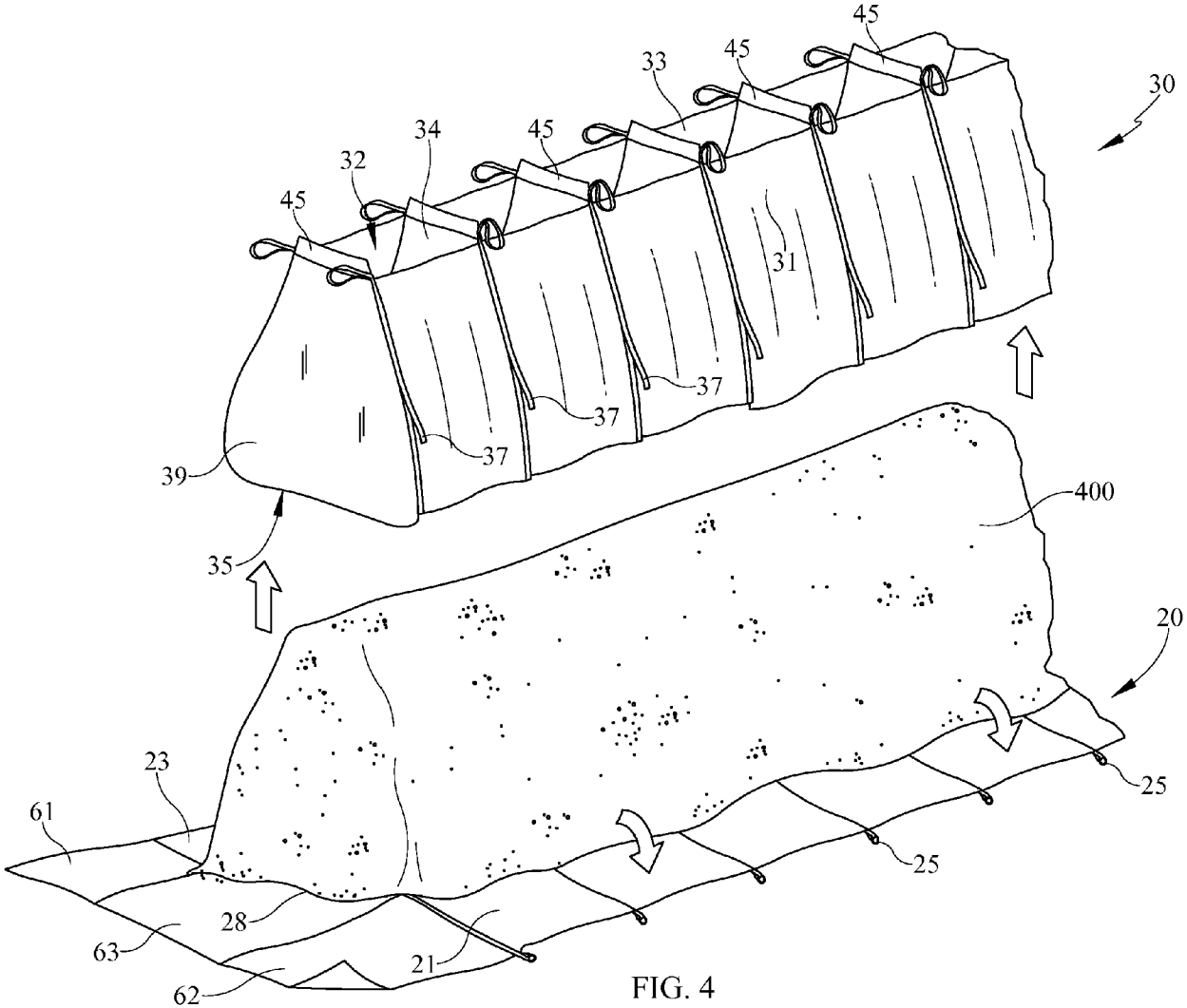
FIG. 4 is a disassembled view of the multi-part reusable levee bag wherein the top bag is removed from the bottom bag portion and the fillable material is exposed.

As further shown in FIGS. 3 and 4, the top bag portion 30 includes an end panel 39 as well as an opposing end panel not shown in this view. At least one baffle or side panel 34 is interposed between opposing end panels. As well, a first side panel 31 and a second side panel 33 define an open top 32 and an open bottom 35. In some embodiments, the open top 32 is dimensionally smaller or narrower than the open bottom 35. End panel 39 may be positioned on a first end with the opposing end panel being a corresponding side panel. Further, the plurality of baffle panels or side panels 34 may be regularly intermittently positioned between end panels 39 to form individual compartments of the interior space 90 which extend the length of the top bag portion 30 as well as reusable multi-part levee bag 100.

Top bag portion 30 may have opposing end panels 39 with a plurality of baffle or side panels 34 interposed therein and connecting the first side 31 and the second side 33 such as for example the front and rear surfaces of the levee bag 100. Use of such multiple compartments formed within the interior of the top bag portion 30 provides the filled bag with a solid constitution and allows the multiple compartments to be individually filled while also preventing the material from flowing out should a single compartment be torn or otherwise exposed.

The top bag portion 30 may also include a plurality of guides 38 extending upward from, in some embodiments, both the first side panel 31 and the second side panel 33. Other connection points may as well be implemented, such as placing guides along top edges of end panels, side panels or baffles or any other relevant position.

Figure 5:
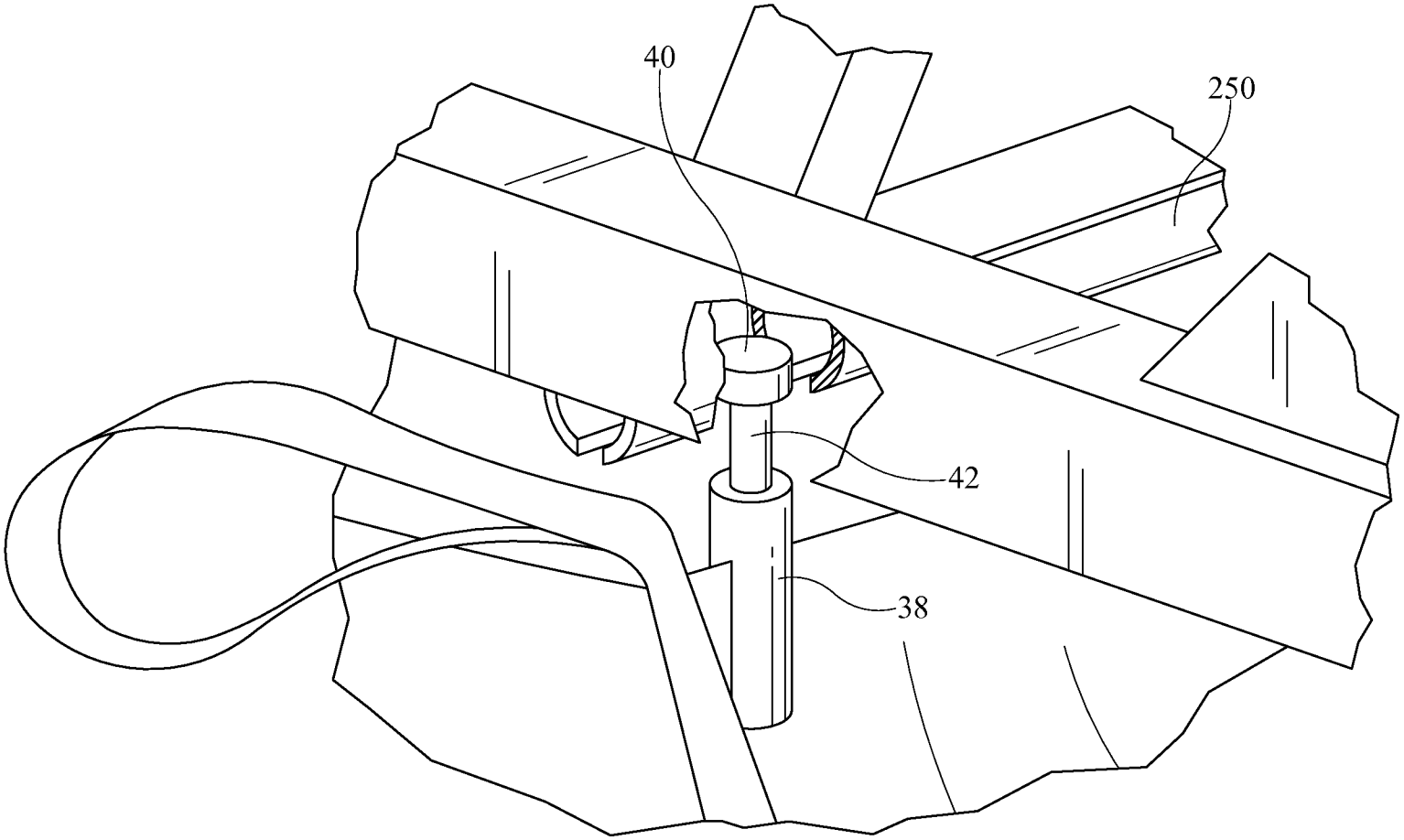
FIG. 5 illustrates a close up view of one alternative guide structure allowing the reusable levee system bag to be slidably affixed to a bag filling frame.

As shown and depicted in the various embodiments of the figures, the guides extend from a top edge of the side panels and include, as shown in FIG. 5, a guide head 40 and a guide neck 42 which allows the guide 38 to slide along a first and second expanded sections or rails 250 of the bag filling frame 200. Various other guide mechanisms may be utilized apart from the specific guides depicted herein and particularly, alternative constructions of guides which allow the bag to slide along any bag filling frame or sled may be utilized. Such implementation of the particular guide shown in the figures is not to be construed as limiting as many other constructions are available to be utilized to accomplish sliding of the top bag and multi-part levee bag within a frame.

An alternative guide structure and embodiment for the levee bag is shown in FIGS. 6-9 wherein a sleeve 45 extends across the top edge of the end panel 39 and the baffle or side panels 34. In such structure, the hangar guide bar 70 is positioned transverse to the longitudinal axis of the reusable levee bag system 100. The sleeve 45 may be continuous, intermittent or may be loop retention structures which receive a hangar guide bar 70 or guide therethrough. Hangar guide bar 70 can be of various constructions as long as it can support or at least partially support the assembled reusable levee bag 100. The hangar guide bar 70 may extend through such loops or sleeve 45 and be slidably retained on the frame 200 by inverted L-shaped brackets 72 positioned on either end of the hangar guide bar 70. These brackets 72 may then slide along the runner 80 positioned at the bottom of the hopper panels 82 allowing the reusable levee bag 100 to slide below the hopper. The hangar guide bars 70 may then support the bag along a transverse direction of the reusable levee bag 100.

Reusable levee bag 100 may also include upper or top bag portions 30 which are made of a differing material than the bottom bag portions 20. Top bag portion 30 may be made of a strong thermoplastic based material, such as polypropylene, which can withstand significant force during assembly, filling, and disassembly of the two-part bag. Top bag portion 30 typically receives substantial tearing or shearing forces during the filling or disassembly operation and thus it may be desirable to manufacture the top bag portion 30 of a strong more resilient material. Alternatively, the reusable two part levee bag 100 may include a bottom bag portion 20 which may be comprised of a natural plant fiber based material and thus, upon disassembly, may remain in place without having a negative environmental impact.

The top bag portion 30 may, in various embodiments, be substantially comprised of a non-biodegradable material. The top bag portion may further, in some embodiments be made of a mix of biodegradable and non-biodegradable material. The top bag portion may further, in still other embodiments, be substantially comprised of biodegradable material.

The bottom bag portion 20 may, in various embodiments, be substantially comprised of a biodegradable material. The bottom bag portion 20 may further, in various embodiments, be made of a mix of materials, said mix of materials being substantially biodegradable. Thus, an amount of the bottom bag portion may readily biodegrade with other non-substantial non-biodegradable materials provided in the bottom bag portion to increase strength and stability. A mix of thermoplastic and biodegradable materials may thus comprise the bottom bag portion, in various embodiments and constituent percentages. The non-substantial non-biodegradable portions of the bottom bag portion 20 may be positioned in structurally significant areas, such as seams or load bearing areas. Or, the non-substantial portions may be made of a differing biodegradable material. However, the bottom bag portion 20, even though having a mix of biodegradable material forming a substantial portion thereof, may readily and substantially be subject to biodegradation. Receiving cell 60 may be included with or as a part of bottom bag portion 20, and/or any or all of the aforementioned characteristics (e.g., materials used) used to describe bottom bag portion 20 may be used to describe receiving cell 60 or any component thereof.

In some embodiments, the bottom bag portion 20 may be made of a biodegradable material such as jute or other plant based fibers. Such materials provide resiliency and strength but are readily biodegradable after prolonged exposure. Such materials may be a natural fiber, animal or vegetable fibers and more particularly may be bast fibers or more particularly a ligno-cellulosic fiber. Alternative materials include hemp, ingeo, calico, cotton, bamboo, organic wool, ramie, tencel or nettle. By biodegradable, it is meant to include, among other things, the chemical dissolution of materials by bacteria or other biological means capable of decomposing substantially back to natural elements. This may further include artificial materials that are similar enough to plant and animal matter to be put to use by microorganisms. Such variant embodiments are not considered to be limiting and are provided merely as exemplary as various other biodegradable plant based, organic, artificial or other material may be used to form the bottom bag portion 20 (and/or receiving cell 60).

It may be desirable in some embodiments to utilize a biodegradable material such that, upon disassembly of the reusable levee bag 100, the bottom bag portion 20 may remain in place while the top bag portion 30 may be reconditioned and reused. This may be particularly useful if the bottom bag portion 20 is not readily accessible due to flooding, mud cake or other issues.

Figure 6:
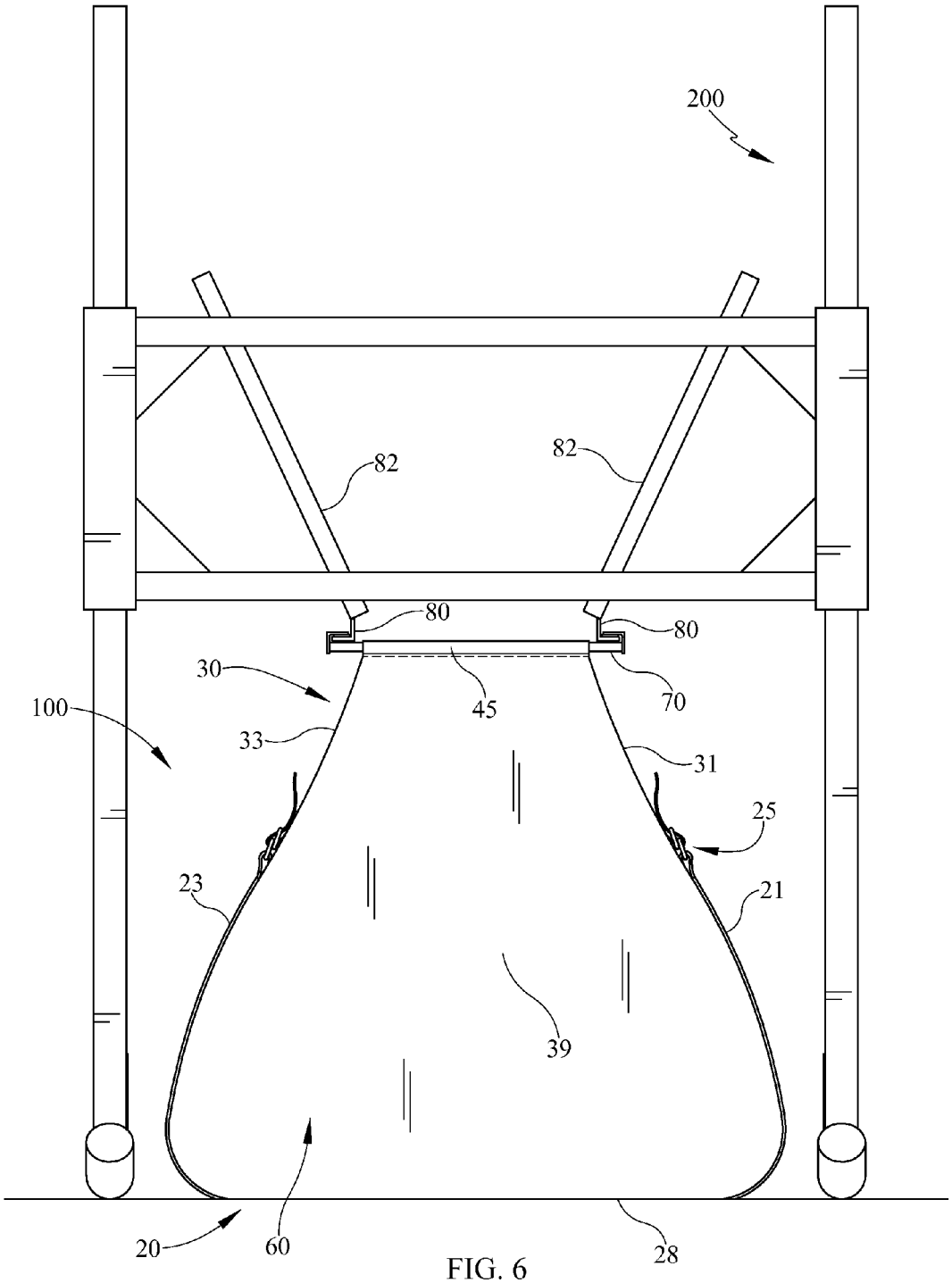
FIG. 6 illustrates a side view an alternative guide and bag construction of the reusable levee bag.
Figure 7:
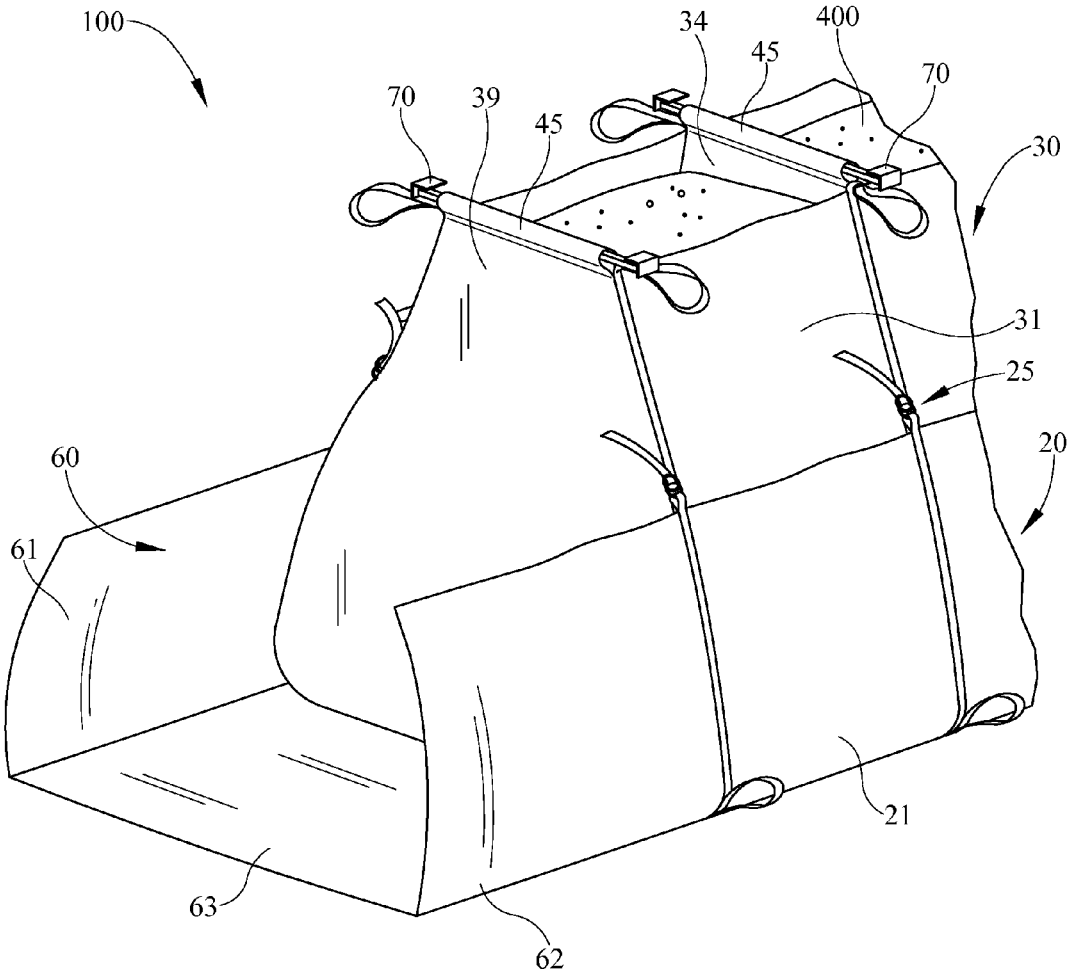
FIG. 7 illustrates an upper perspective view of the alternative guide and bag construction of the reusable levee bag.
Figure 8:
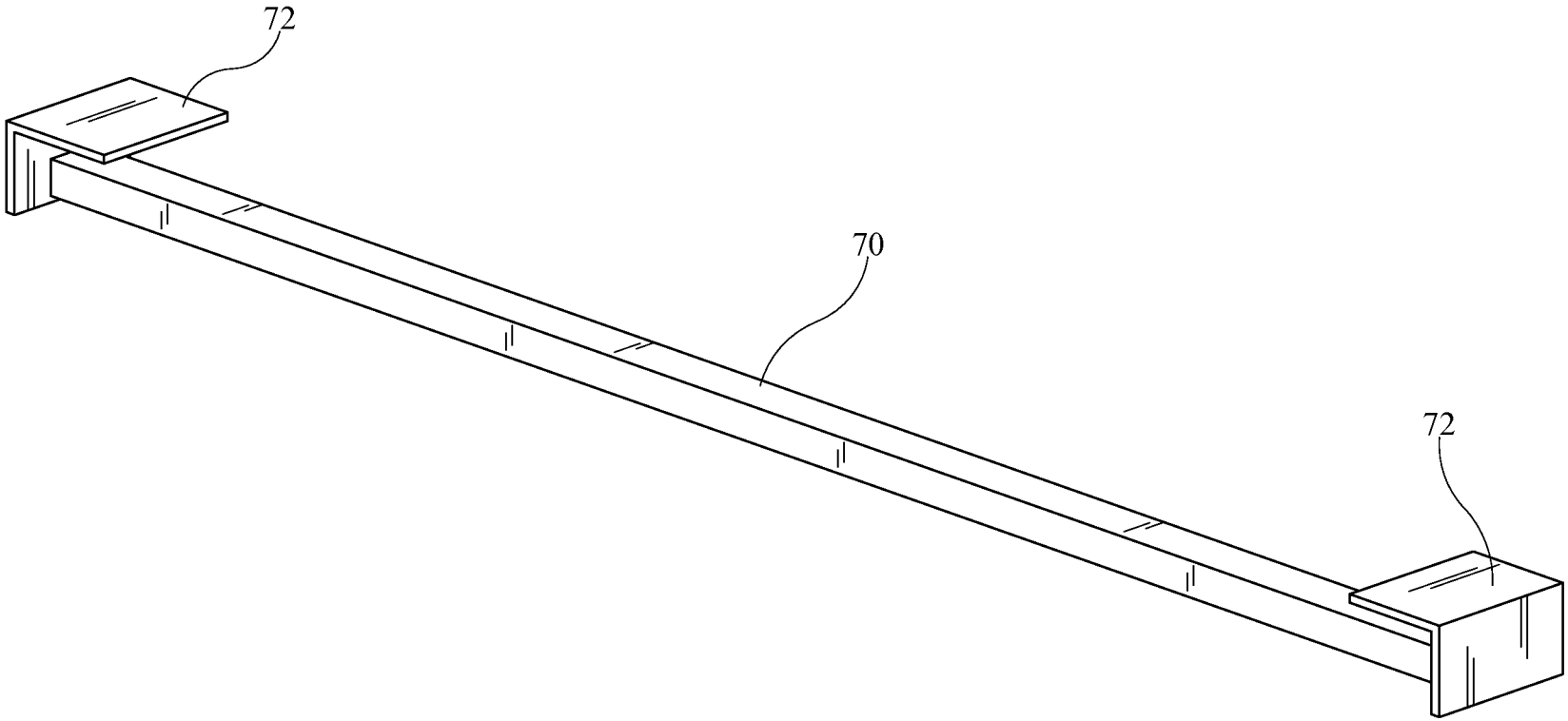
FIG. 8 illustrates an alternative hangar bar and guide structure of the reusable levee bag.
Figure 9:
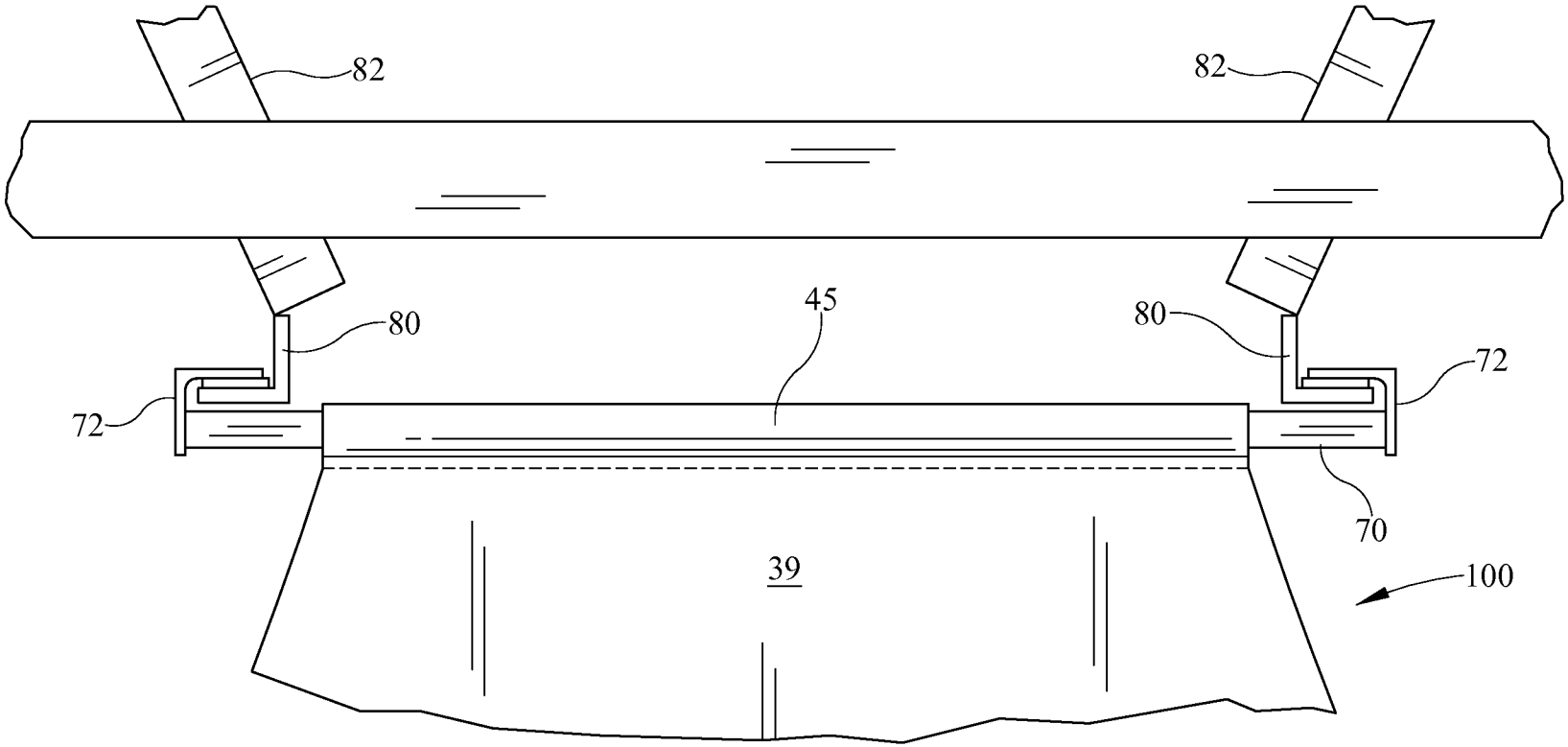
FIG. 9 illustrates an end view an embodiment of the guide bar and filling frame interconnectivity of the reusable levee bag.

As depicted in the various figures and as well in FIG. 6, the top bag portion 30 is removably affixed to the bottom bag portion 20 utilizing a number of various alternative connectors 25. Once the multi-part reusable levee bag 100 is assembled and filled via the frame 200, the interior compartments or one or more interior spaces 90 of the bag between end panels 39 are filled with sand or like fillable material. As depicted in FIG. 4, the top bag portion 30 may be pulled away from the bottom bag portion 20. During this disassembly operation, substantial upward force may be used to remove the top bag portion 30 thereby allowing the fill material to spill. In some instances, it may be desirable to maintain the bottom bag portion 20 (which may include, or have connected thereto, receiving cell 60) in place instead of removing the sand or other material filling the levee bag 100. In some instances, bottom bag portion 20 may become caked or embedded in the soil due to flooding, or may merely be inaccessible. As a result, in various alternative embodiments, it may be desirable for the bottom bag portion 20 to be made of a biodegradable material such that it may be left in place without having a negative environmental impact.

In various embodiments, a top bag portion may include a thermoplastic material and may be combined with a bottom bag portion comprising at least a substantial amount of biodegradable material. In various embodiments, the bottom bag portion may formed of jute or similar organic or plant based material. Such bottom bag portion may be formed using known textile methods, particularly using alternative strengthening material along seams and other areas to ensure the structural integrity of the bottom bag portion and of the affixation of the top bag portion thereto. Thus, the bottom bag portion may be primarily made of a biodegradable material while also including a strengthening non-biodegradable material. Alternatively, the bottom bag portion may be comprised of substantially all biodegradable material with a mix of varying strength such material mixed in different amounts or at differing locations of the bottom bag. Various alternative connectors 25, as described herein, may be utilized to secure the biodegradable bottom bag portion to the top bag portion.

Returning to FIGS. 3 and 4, the top bag portion 30 includes the end panel 39 shown in the figure and having opposing first and second side panels 31, 33. The end panels 39 and first and second side panels 31, 33 in combination with the baffles or side panels 34 form an interior space 90 in which the fillable material may be deposited. The one or more baffles 34 interrupt the interior space 90 defined by the top bag portion 30 and bottom bag portion into a plurality of individual compartments. The top bag further has an open top 32 and open bottom 35, the open bottom substantially closed off by the bottom bag portion 20 and bottom panel 28 once connected to the top bag portion 30. The bottom panel 28 of the bottom section generally is in alignment with the open bottom 35 of the top bag portion 30. In various embodiments, the bottom bag portion 20 may include first and second side flaps 21, 23, that extend from the bottom panel 28, which extend upwards on the exterior surface of the top bag portion 30 so that the various alternative connectors, for example D-rings, 25 are accessible to the straps 37. However, many other constructions are available for positioning of the bottom bag portion 20 in general alignment with the open bottom to effectively seal the open bottom of the top bag from dispensing fill material.

The bottom bag portion 20 is, in various embodiments, removably attached to the top bag portion 30 by various removable attachment mechanisms and may be, in some embodiments, connected by a plurality of straps 37. The straps 37 may depend or extend on an exterior surface of the top bag and be received within various alternative connectors 25. The strap receiving mechanisms may include rings, D-rings, loops or other structure and as well, the position of the straps and strap receiving mechanisms may be interchanged. For example, the straps may extend upwards from the bottom section to be received at the top bag or other configurations to effectively connect the two sections together.

Various known removable attachment mechanisms or connectors may be interposed between the top bag portion 30 and the bottom bag portion 20 such that the top bag portion may be removably affixed and attached to the bottom bag portion in order to define an interior space which may receive fillable material and which allows the top bag to be removed and separated from the bottom bag after filling. Such removable attachment mechanisms or connectors allow the top bag to be securely affixed to the bottom bag during the filling operation and during use and may include straps, hook and loop fasteners, mechanical buttons, zip systems, temporary stitching, fold lines, flaps or other structure. Various such connectors, removable attachment structures or removable affixation means may be implemented to removably affix the top bag portion to the bottom bag portion and the embodiments shown herein are provided to exemplify one variation of removably attachable mechanisms to removably attach the two portions together. Attachment mechanisms may be used to attach, fasten, and/or secure a first levee bag 100 to a second levee bag 100, for example, when a portion of a second levee bag (e.g., the male end) is inserted, within, and/or mated with receiving cell 60 of a first levee bag 100.

As shown in the figures, the top bag has an open top 32 and an open bottom 35 wherein the open bottom is larger in diameter or area or dimensionally larger than the open top 32. In the depicted embodiment, the larger opening at the bottom allows more ready dispensing of the interior fillable material contents of the multi-part bag once disassembly and detachment of the two portions is completed. As well, in various embodiments, similar sized openings for the top and bottom of the top bag portion may be implemented. Narrowing of the upper entry area or open top of the top bag as compared to the open bottom area of the top bag is not necessary in order to effectuate a multi-part reusable levee bag as described and illustrated herein. Receiving cell 60 may, in some embodiments, substantially match the shape and/or profile (e.g., wider base and narrower top) of top bag portion 30, which may facilitate mating a first levee bag 100 to a second levee bag 100. However, it is understood that receiving cell 60 may be shaped independently of top bag portion 30.

The open bottom of the top bag portion may be closed off with the bottom bag portion 20, the bottom bag portion 20 including a central bottom panel 28 and first and second side flaps 21, 23 both of which extend upward towards the open top of the top bag portion. The first and second side flaps 21, 23 may be wrapped on an exterior or interior surface of the top bag and is designed to effectively close off the open bottom 35 of the top bag and prevent significant dispensing of the flowable material 400 once contained into the interior area of the multi-part bag. By wrapping the side flaps 21, 23 around the walls of the top bag, flowable material 400 within the compartments of the assembled bag does not leak through when the bag is submerged or exposed to water or current. Alternatively, and in various embodiments, additional structure of the bottom bag portion and/or receiving cell may connect to the top bag portion end panel in an operlapping engagement to reduce the escape of flowable material 400, similar to side flaps 21, 23. Such as for example, an end flap may also be provided which may be folded up along the bottom edge of the end panel 39 of the top bag and be secured thereto in order to prevent leakage of the fillable material out of the lower edge of the end panel 39. Such an end flap may be connected to the end panel 39 by hook and loop type fasteners, buttons, straps or other removably affixable mechanisms. An end flap may as well be constructed in alternative embodiments as a V-shaped configuration to receive between each V-shaped panel the end panel 39 of the top bag. By including the end panel 39 of the top bag into a V-shaped end flap of the bottom bag portion 20 or a single end flap, as shown in the various embodiments, securement of the end panel 39 of the top bag and prevention of leakage for sand or other flowable material occurs. It is understood that some embodiments, such as embodiments including receiving cell 60, for example, may be practiced without use of an end flap such as the end flap previously described. Such various alternatives of the removably affixable mechanisms may be utilized throughout the construction of the multi-part reusable levee bag illustrated herein in combination with other functionally similar structures.

As illustrated in the various embodiments depicted within the figures, the top bag portion 30 may have a generally multi-sided or quadrilateral cross-sectional shape which utilizes a narrower top and a wider bottom in order to increase the stability of the filled multi-part reusable levee bag. The construction of the levee bag as shown in the various embodiments may as well increase the ability of the top bag portion 30 to be lifted away from the bottom bag portion 20 once the levee bag has been used. The bag cross section may be quadrilateral, multi-sided or alternative shape. As well, in various constructions, the bags may be various cross sections. In some examples, this cross section may be multi-sided. Receiving cell 60 may have a similar cross-section to that of top bag portion 30 due to, for example, attachment of side flaps 61 and 62 and bottom panel 63 to portions of bottom bag portion 20 intended to wrap around or within top bag portion 30. It is understood, however, that receiving cell 60 may have a cross-section that is different than that of top bag portion 30 and/or shaped independently of the cross section of top bag portion 30. Such are merely exemplary and provided for explanatory purposes only. Further, among the multiple embodiments and examples provided, it is merely meant, among other non-limiting examples, that the cross sectional shape may generally be square, a convex quadrilateral with at least one pair of parallel sides and may also include a five or more sided polygon. As set forth in the various depicted embodiments, a multi-sided top bag is disclosed with a smaller length top edge as compared to bottom edge. However, alternative constructions having non-parallel edges or mating walls may be implemented. Alternatively, however, in some embodiments the bag may have more than four sides and may be a complex shaped, five or more sided configuration.

Other constructions and shapes may be utilized for the top bag portion 30 and the cross-sectional shape depicted herein and within the figures is merely used for explanatory purposes only. No limiting interpretation of the specific geometric dimension and shapes shown in the figures is to be read into the appended claims or interpreted as being necessary to accomplish the various structures and methods of the apparatus disclosed herein. Such alternative constructions include square, triangular, rectangular and other geometric configurations allowing the interior of the combined top and bottom bag portions to be filled.

In use and as provided in this example, the top bag portion 30 and the bottom bag portion 20 may be removably affixed together as shown in various figures and installed within a bag filling frame 200. Sections of the combined top and lower bag portions may be positioned in the frame in an expanded bag section or expanded section 50 with other sections in a collapsed bag section 58 as depicted in FIG. 1. Thus, long stretches of the combined bag may be installed within a frame for filling in rapid succession. The combined bags may be slidably retained within the frame 200 by a plurality of guides 38 which are received within expanded sections or rails 250. The expanded section 50 may be placed under a funneled filling area of the frame so that sand or other fillable material may be deposited into the funnel area and fall directly into the expanded or opened section of the multi-part bag. Strap handles 52 and 54 may be positioned at various points on both the bottom bag portion 20 and the top bag portion 30 in order to aid in both the installation, assembly and then subsequent disassembly of the multi-part reusable levee bag 100.

A first levee bag 100 may be filled and/or positioned as desired, for example, with receiving cell 60 erected (e.g., in substantially U-shape with bottom panel 63 forming the bottom and side flaps 61 and 62 forming the opposing sides). Receiving cell 60 may, when erect, be ready to receive and/or mate with a male end of another levee bag 100 (e.g., the end of another levee bag 100 opposite receiving cell 60). For example, the end of levee bag 100 opposite the receiving cell 60 may be sized, shaped, and/or configured for insertion into receiving cell 60 (i.e. receiving cell 60 may be akin to a female end and the opposite end may be akin to a male end, which may be mated together). The male end of a second levee bag 100 may be inserted into receiving cell 60 of a first levee bag 100, and/or the first and second levee bags 100, arranged end to end, may be attached, connected, secured, and/or fastened together in any of a variety of ways. Attachment mechanisms that may be used include, but are not limited to, sewing, gluing, stitching, welding, stapling, nailing, bolting, tying of straps and/or loops, attaching via hook-and-loop style and/or other fasteners, bonding, or any other attachment mechanism, or any combination thereof. Such attachment of a first levee bag 100 to a second levee bag 100 may serve any of a variety of purposes, including, but not limited to, sealing any gaps or openings that may be present or form between the ends of adjacent levee bags 100 and/or to add structural rigidity of a combination of levee bags 100 attached end to end.

The combined multi-part reusable levee bag 100 may be slidably retained within frame 200 and filled while the frame is slowly retracted backwards towards the collapsed bag section 58 of the combined top 30 and bottom bag 20 portions thereby producing a combined filled bag portion and unfilled bag portion as shown and illustrated in FIG. 2. The frame 200 may be retracted over the collapsed section in order to easily expand the collapsed bag section 58 into an expanded section 50 for filling as shown in FIG. 1, so that the filling operation may continue.

After filling of the bags in place, the combined multi-part reusable levee bag or bags 100 may act as a levee bag for flood control, retaining walls, earthen dam, erosion control, concrete walls, and other known uses. The multi-part bags may further be disassembled and reused by removing the fillable material therein without destroying the integrity of the bags.

As shown in FIG. 4, the top bag portion 30 may be detached from the bottom bag portion 20 by disconnection of the straps or detachment of other removably attachment or affixable structure. As shown, once the straps or other mechanism are detached, the top bag portion 30 may be lifted away from the bottom bag portion 20, thereby spilling the interior contents of the fillable material and allowing the top and lower or bottom bag sections to be reused. Strap handles 54 extending along the top edge of either side of the top bag may be utilized for raising the top bag portion 30 away from the bottom bag portion 20 and allowing the contents therein to flow through the open bottom 35 and the top bag to be pulled away from the fillable material and bottom bag portion. Remaining fillable material may be moved aside of the bottom bag portion 20 and the bottom bag portion may similarly be reused.

In various constructions, the top bag and bottom bag may be made of various materials including polypropylene, high strength canvas or the like. It may be desirable to incorporate material which is impervious to water and which sufficiently retains the fillable material therein. The fillable material may include not only sand, dirt or other fill material but may also include concrete and the like should a permanent structure be required.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A reusable levee bag, comprising:

a top bag portion having an open top and an open bottom and a first end panel and second end panel;

a plurality of guides extending from said top bag portion; said top bag defining an interior space;

a bottom bag portion removably retained to said top bag portion;

said bottom bag portion having a first end including a receiving cell, and a second end opposite said first end;

said receiving cell having a first side flap and an opposing second side flap;

said second end of said bottom bag portion is insertable into said receiving cell of another bottom bag portion of another reusable levee bag;

said interior space of said top bag portion being interrupted by a plurality of baffle panels; and wherein a combined said top bag portion and said bottom bag portion define an enclosed levee bag capable of receiving flowable material.

2. The reusable levee bag of claim 1, wherein said top kg portion is made of a first material and said bottom bag portion is made of a second material, wherein said second material is at least partially biodegradable.

3. The reusable levee bag of claim 1, wherein said plurality of baffle panels extend from a first side panel of said top bag portion to a second side panel of top bag portion, said plurality of baffle panels positioned between said first end panel and said second end panel of said top bag portion.

4. The reusable levee bag of claim 3, wherein said plurality of baffle panels extend substantially from said open bottom to said open top.

5. The reusable levee bag of claim 1, wherein said plurality of guides are a plurality of hangar guide bars.

6. The reusable levee bag of claim 1, wherein said plurality of guides are a plurality of travel guides having a narrow neck and an ovalized head.

7. The reusable levee bag of claim 1, wherein said bottom bag portion is removably affixed to said top bag portion by a plurality of connectors.

8. The reusable levee bag of claim 1, wherein said receiving cell includes a bottom panel creating a U-shape with said first side flap and said opposing second side flap.

9. A reusable levee bag, comprising:

a top bag portion and a bottom bag portion, said top bag portion removably attached to said bottom bag portion;

said top bag portion having an open top and an open bottom, said open top adapted to receive a flowable material;

wherein said top bag portion is removably attached to said bottom bag portion by a plurality of removably attachable connectors;

said bottom bag portion having a first end including a receiving cell, and a second end opposite said first end;

said receiving cell having a first side flap and an opposing second side flap;

said second end of said bottom bag portion is insertable into said receiving cell of another bottom bag portion of another reusable levee bag; and said top bag portion and said bottom bag portion defining an enclosed interior forming a levee bag.

10. The reusable levee bag of claim 9, further including a plurality of guides affixed to said top bag portion configured to allow said reusable levee bag to slide along a first rail and a second rail of a levee bag filling frame.

11. The reusable levee bag of claim 9, wherein said receiving cell includes a bottom panel creating a U-shape with said first side flap and said opposing second side flap.

12. The reusable levee bag of claim 9, wherein said top bag portion is made of a first material and said bottom bag portion is made of a second material, wherein said second material includes both a biodegradable material and a non-biodegradable material.

13. The reusable levee bag of claim 9, wherein said open top of said top bag portion is dimensionally smaller than said open bottom of said top bag portion.

14. A two piece reusable levee bag, comprising:

a top bag portion and a bottom bag portion, said top bag portion removably affixed to said bottom bag portion;

a combined said top bag portion and said bottom bag portion forming an enclosed interior space having a plurality of baffles;

said top bag portion having a top opening and a bottom opening, wherein said top opening is smaller than said bottom opening;

wherein said combined top bag portion and bottom bag portion receives a flowable fill material;

said bottom bag portion having a first end including a receiving cell, and a second end opposite said first end;

said receiving cell having a first side flap and an opposing second side flap; and said second end of said bottom bag portion is insertable into said receiving cell of another bottom bag portion of another two piece reusable levee bag.

15. The two piece reusable levee bag of claim 14, wherein said bottom bag portion being made of at least a biodegradable material.

16. The two piece reusable levee bag of claim 15, wherein said bottom bag portion includes a portion of non-biodegradable material.

17. The two piece reusable levee bag of claim 14, wherein said receiving cell includes a bottom panel creating a U-shape with said first side flap and said opposing second side flap.

18. A system of reusable levee bags comprising:

a first levee bag having a first portion and a second portion combining to form one or more interior spaces to receive a flowable material, said first levee bag having a first end and an opposing second end, wherein said first end includes a receiving cell;

a second levee bag having a first portion and a second portion combining to form one or more interior spaces to receive a flowable material, said second levee bag having a first end and an opposing second end; and wherein said receiving cell of said first levee bag receives said second end of said second levee bag.

19. The system of reusable levee bags of claim 18 wherein at least one of said first portion and said second portion of either said first levee bag or said second levee bag being made of at least a biodegradable material.

20. The system of reusable levee bags of claim 18 wherein one or more connectors removably attach said first portion to said second portion of at least one of said first levee bag and said second levee bag.

* * * * *